US006561276B2

(12) United States Patent
Hamilton

(10) Patent No.: US 6,561,276 B2
(45) Date of Patent: May 13, 2003

(54) BORE SELECTOR

(75) Inventor: Scott M. Hamilton, Lanark (GB)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/861,410

(22) Filed: May 18, 2001

(65) Prior Publication Data

US 2002/0066559 A1 Jun. 6, 2002

(30) Foreign Application Priority Data

May 19, 2001 (GB) ..... 0012207

(51) Int. Cl.[7] ..... E21B 17/18
(52) U.S. Cl. ..... 166/339; 166/341; 166/242.3
(58) Field of Search ..... 166/339, 341, 166/242.3, 343

(56) References Cited

U.S. PATENT DOCUMENTS

| | | | | |
|---|---|---|---|---|
| 3,395,731 A | * | 8/1968 | Kauffman | |
| 3,527,252 A | * | 9/1970 | Cook et al. | |
| 3,664,376 A | | 5/1972 | Watkins | |
| 3,762,664 A | * | 10/1973 | Loveless | 137/874 |
| 3,771,560 A | * | 11/1973 | Conti et al. | 137/874 |
| 3,834,418 A | * | 9/1974 | Clancy | 137/625.48 |
| 4,312,378 A | | 1/1982 | Dollison | |
| 5,357,999 A | | 10/1994 | Loth et al. | |
| 5,377,762 A | | 1/1995 | Turner | |
| 6,170,578 B1 | * | 1/2001 | Edwards et al. | 166/339 |
| 6,345,668 B1 | * | 2/2002 | Reilly | 166/208 |

FOREIGN PATENT DOCUMENTS

| | | |
|---|---|---|
| GB | 1 375 451 | 11/1974 |
| GB | 2 170 579 A | 8/1986 |
| GB | 2 343 236 A | 5/2000 |

* cited by examiner

*Primary Examiner*—Heather Shackelford
*Assistant Examiner*—T. Shane Bomar
(74) *Attorney, Agent, or Firm*—Henry C. Query, Jr.

(57) ABSTRACT

A standard ROV/manual gate valve operating mechanism is used to move a bore selector between the production and annulus bores of a completion. The ROV operation could be via torsion or linear action. The positioning of the selector may be hydraulically linked to the functioning of retainer valves. Alternatively, the operating mechanism may be for one of the retainer valves, with a mechanical linkage for actuation of the bore selector.

15 Claims, 4 Drawing Sheets

BORE SELECTOR

BACKGROUND OF THE INVENTION

Open water risers are used to install, retrieve and work on conventional subsea Christmas trees. At the bottom of such risers can be found an emergency disconnect package (EDP) which includes a connector for emergency release of the riser from the Christmas tree and optionally, retainer valves on the riser bores to automatically close and retain fluid in the riser.

Conventional Christmas trees frequently are configured to have dual bores for the production tubing and for tubing annulus access. With the advent of deeper water systems, this has led to the use of monobore riser systems which require a bore selection device for pressure, wireline and coiled tubing access to either Christmas tree bore.

There are advantages associated with having a simple bore selection device which is located on the EDP. The operating mechanism of this device should ideally be reliable, field proven and flexible to the customer's operating requirements, i.e. manual, hydraulic, fail safe to production, fail safe to annulus, providing position indication or automatic operation linked to the retainer valve functions.

SUMMARY OF THE INVENTION

The present invention provides a monobore riser bore selector comprising a sealed housing in which an unsealed guide is mounted for pivotal movement into selective alignment with each of a plurality of bores; a linearly movable stem being connected to the guide to cause said pivotal movement, the stem extending through a seal in the housing so that an end of the stem is positioned externally of the sealed housing, the externally positioned end being provided with a grab formation or being connected to an actuator stem extension for movement of the stem and the guide. For example, the bore selector may be moved into alignment with either a production bore or an annulus bore of a completion, as desired. The stem may be a standard ROV/manual operated gate valve operating mechanism. The ROV operation could be via torsion or linear actuation. In addition, standard gate valve UV stem and bonnet gasket sealing technology (as available from the applicants) can be used to isolate the bore selector cavity from the environment. This arrangement provides a reliable, flexible and field proven design.

Additionally or alternatively, the stem may be hydraulically actuated. The stem may be biased as desired to provide fail safe operation of the bore selector to the production bore position, to the annulus position, or to any other position.

Additionally or alternatively, the hydraulic circuitry of the stem actuator may be linked to that of the retainer valves, so that positioning of the bore selector is linked to the retainer valve functions (for example automatically pointing the bore selector at whichever valve is open if only one is open, or allowing bore selection by the operator if both retainer valves are open, or pointing at the last valve to open if both are open).

A further alternative is to mechanically link the bore selector for actuation by one of the retainer valve actuators, i.e. the stem actuator is one of the retainer valve actuators. For example, if the bore selector is mechanically linked to the production retainer valve, opening that valve could be arranged to cause the bore selector to point to the production bore. Conversely, closing the production retainer valve would then cause the mechanical linkage to align the bore selector with the annulus bore.

The bore selector is preferably a simple non-sealing tube or guide. It may be hinged for rotation at the top of the selector. At the bottom of the selector a suitable linkage such as a pivoting yoke or saddle may be used to transmit the horizontal stroke of the stem into the swinging motion of the selector. The linkage must permit vertical height change as well as horizontal stroke.

Further preferred features and advantages of the invention are set out below in the following description of illustrative embodiments, made with reference to the drawings.

DETAILED DESCRIPTION OF THE PREFERRED EMBODIMENTS

Figure 1:
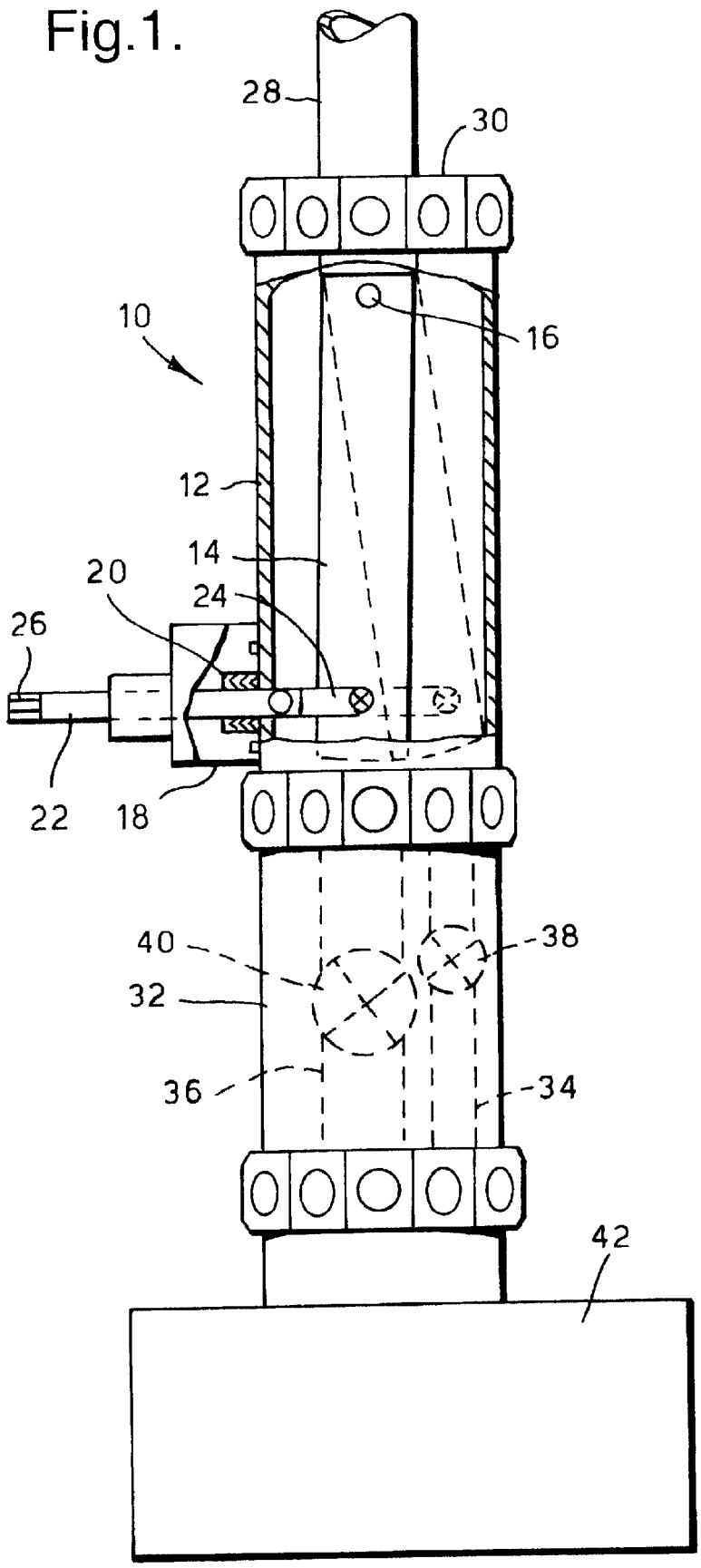
FIG. 1 is a diagrammatic representation of a bore selector embodying the invention, connected between a monobore riser, a retainer valve block and an EDP connector.

FIG. 1 shows a bore selector 10 having a sealed housing 12 within which an unsealed guide or tube 14 is mounted on pivots 16 near its upper end. A boss 18 is bolted and sealed to the housing 12 and contains a stem packing 20. An actuator stem in the form of a simple push/pull rod 22 is slidable through the boss 18 and packing 20 and is connected at its inner end to the tube 14 via a linkage 24. The outer end of the rod 22 is provided with a grab formation 26 for a ROV tooling package or other manual actuation means.

The bore selector 10 is sealingly attached at its upper end to a monobore riser 28 using a "Speedloc"™ connector 30, flange connector or similar means. The lower end of the bore selector 10 is similarly connected to a valve block 32 in which are formed an annulus bore 34 and a parallel production bore 36. Retainer valves 38 and 40 may be used to selectively open and close the bores 34 and 36 respectively. The valve block 32 is connected at its lower end to an EDP 42.

Figure 2:
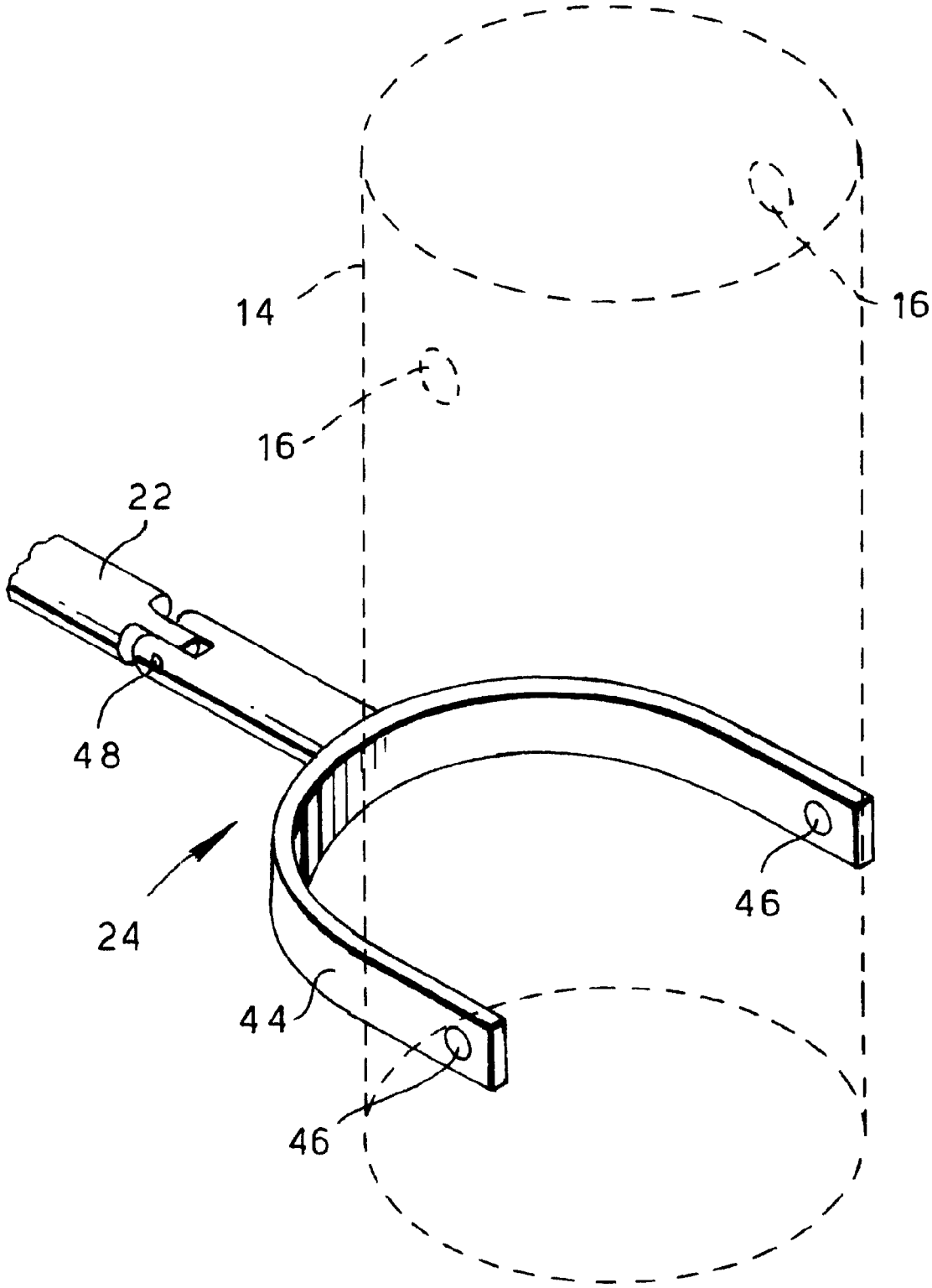
FIG. 2 is a sketch showing details of the stem linkage.

As shown more clearly in FIG. 2, the linkage 24 comprises a yoke or saddle having a bifurcated end 44 connected to the tube 14 by trunnions or similar pivoted connections 46. The other end of the linkage 24 is connected to the push/pull rod 22 by a hinge pin 48. The linear movement of the rod 22 is therefore converted into swinging movement of the tube 14 about the pivots 16, so that the lower end of the tube 14 may be aligned with either the annulus bore 34 or the production bore 36.

Figure 3:
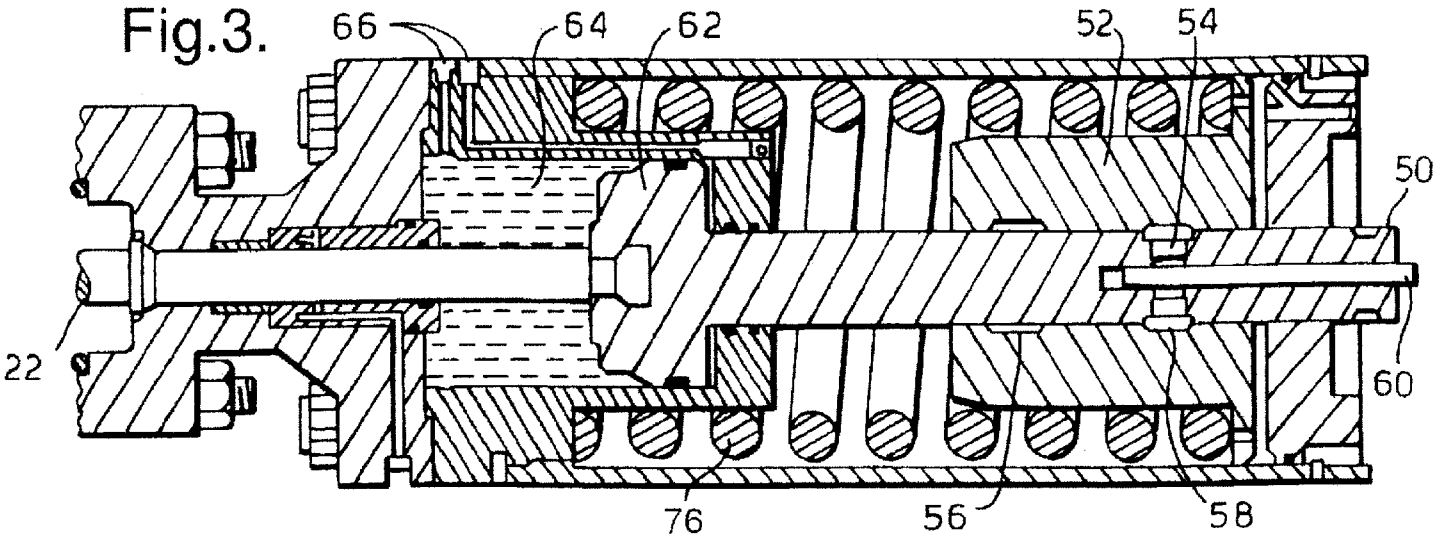
FIG. 3 is a cross-sectional view of a typical hydraulic linear actuator with ROV/manual override.

FIG. 3 shows an alternative hydraulic linear actuator for the rod 22, being of a standard type normally used to actuate a gate valve and more fully described in GB patent specification no. 2343236. The actuator comprises a stem extension 50 accessible from outside the actuator body for ROV/manual linear movement, to provide override operation in the event of hydraulic failure. The stem extension 50 is lockable to a spring compression hub 52 in retracted or extended positions by locking dogs 54 selectively engageable in recesses 56, 58. The locking dogs 54 are operated by a cam spindle 60 coaxially received in the stem extension 50. Hydraulic actuation is by a piston 62 received in a chamber 64 and acted on by hydraulic fluid supplied via ports 66.

Figure 4:
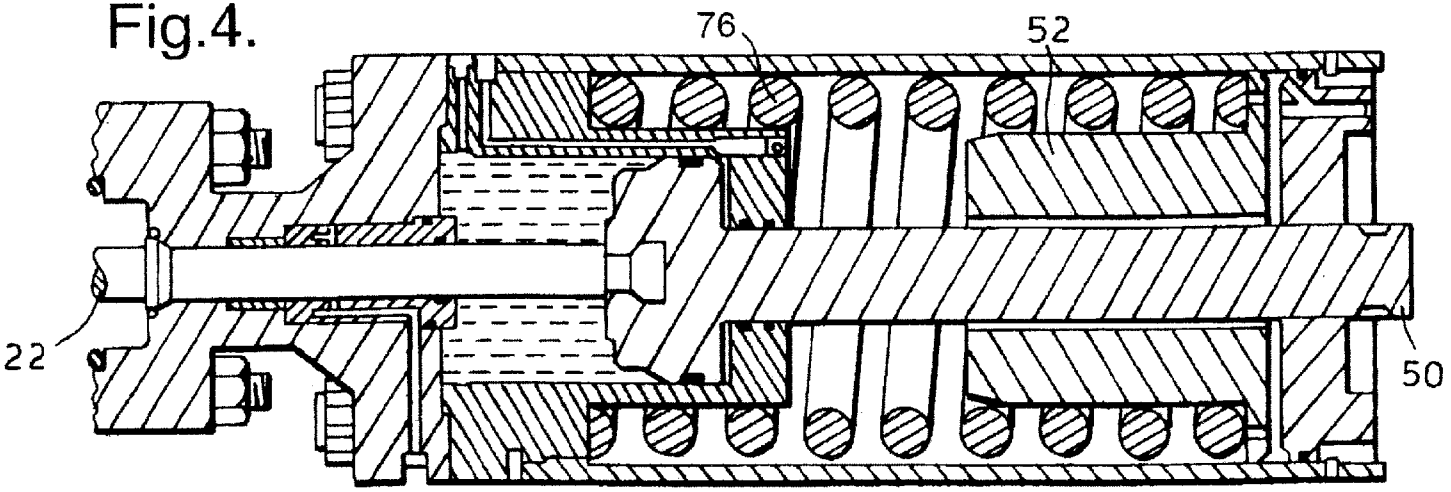
FIG. 4 shows a modified form of the actuator of FIG. 3.

FIG. 4 is similar, except that the stem extension 50 is threadingly received in the compression hub 52, so that ROV/manual override is by the application of torque to the stem extension 50.

Figure 5:
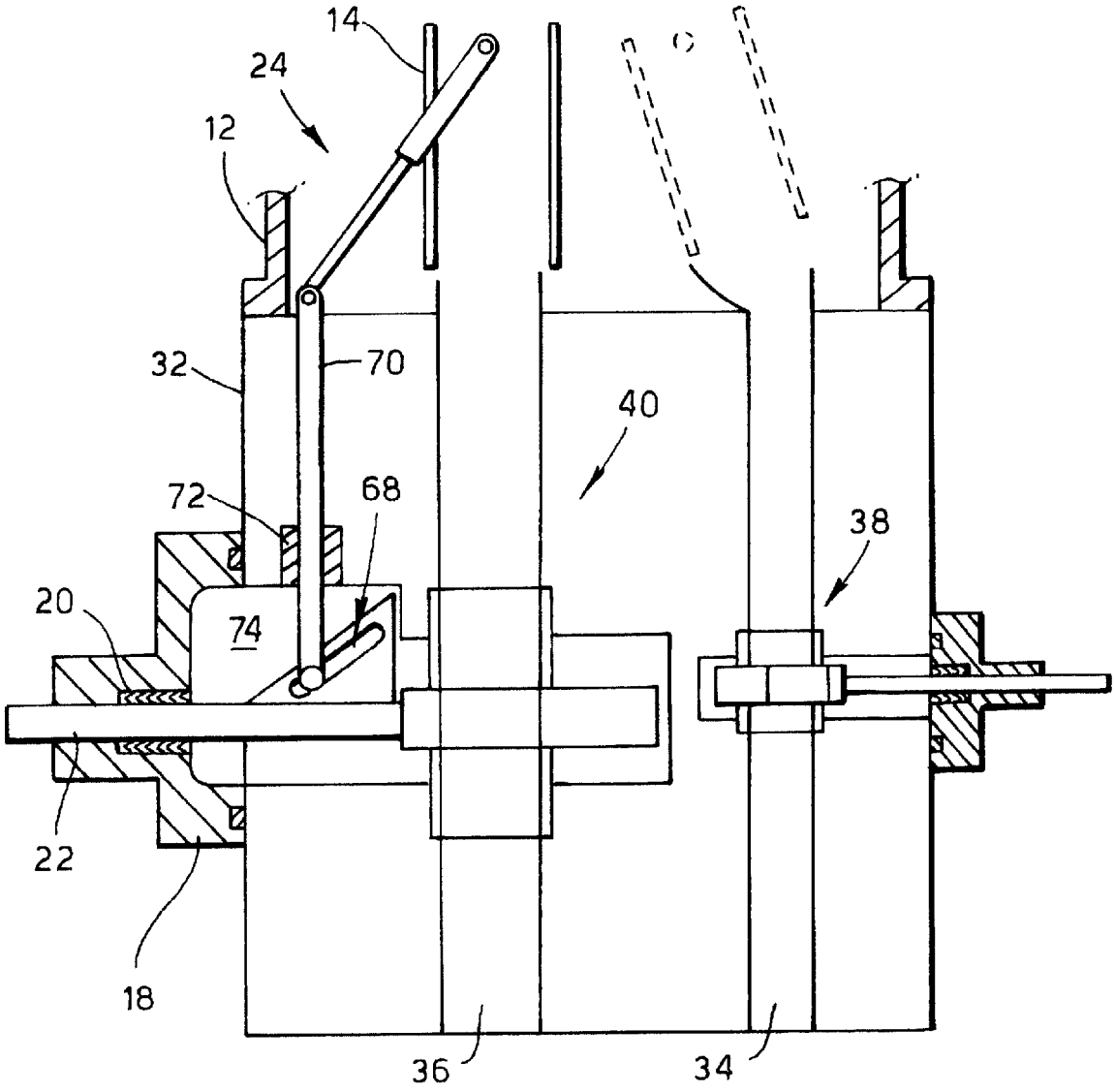
FIG. 5 shows a further embodiment in which the stem actuator is a retainer valve actuator, with a mechanical linkage to the bore selector.

In FIG. 5, the stem or rod 22 actuates the production retainer valve 40, which is a gate valve as shown. A pin and slot connection 68 converts horizontal movement of the rod 22 into vertical movement of a connecting rod 70. A further stem packing 72 around the connecting rod 70 co-operates with the packing 20 to isolate the valve cavity 74. An upper end of the connecting rod is hingedly connected to the linkage 24. The valve 40 is shown in the open position, in which the lower end of the tube 14 is aligned with the production bore 36. As the stem 22 moves the valve gate closed (to the left as shown) the lower end of the tube 14 swings to the right, into alignment with the annulus bore 34, as indicated in broken lines.

Other forms of mechanical linkage between the valve stem 22 and the tube 14 will be readily apparent. The linkage could instead be with the annulus retainer valve 38. The stem 22 and/or the tube 14 can be biased to a particular fail safe position (annulus or production bore selected, whichever is appropriate), for example by a spring such as 76 shown in the actuators of FIGS. 3 and 4. In addition to all of the above, the operating mechanism could be configured with a position indicator for the ROV or a diver to view the actual position of the bore selector. The position indicator can optionally send a position indicating signal to the surface or another remote location.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A monobore riser bore selector comprising a sealed housing in which an unsealed guide is mounted for pivotal movement into selective alignment with each of a plurality of bores; a linearly movable stem being connected to the guide to cause said pivotal movement, the stem extending through a seal in the housing so that an end of the stem is positioned externally of the sealed housing, the externally positioned end being provided with a grab formation or being connected to an actuator stem extension for movement of the stem and the guide.

2. A bore selector as defined in claim 1 comprising a standard ROV/manual operated gate valve operating mechanism.

3. A bore selector as defined in claim 1 which is hydraulically operated.

4. A bore selector as defined in claim 1 which is biased to provide fail safe operation to a predetermined position.

5. A bore selector as defined in claim 1 comprising hydraulic circuitry linked to hydraulic circuitry of riser retainer valves, so that positioning of the bore selector is linked to the retainer valve functions.

6. A bore selector as defined in claim 1, further comprising a linear actuator which is connected to the externally positioned end of the stem, wherein the linear actuator comprises a riser retainer valve actuator.

7. A bore selector as defined in claim 1 wherein the guide comprises a non-sealing tube.

8. A bore selector as defined in claim 1 wherein the guide is hinged for rotation at the top of the bore selector.

9. A bore selector as defined claim 8 wherein at the bottom of the guide a linkage is used to transmit the stroke of the stem into swinging motion of the guide.

10. A bore selector for selectively communicating a first bore which is positioned above the bore selector with either of at least a second or a third bore which are positioned below the bore selector, the bore selector comprising:

a housing having a first end which is sealed to the first bore and a second end which is sealed to a structure in which the second and third bores are disposed;

a tubular guide which is pivotally connected to the housing;

a linearly movable stem having a first end which is connected to the guide and a second end which passes through an opening in the housing; and means for sealing the stem within the opening;

wherein the stem is movable to pivot the guide between at least a first position, in which the first bore is aligned with the second bore, and a second position, in which the first bore is aligned with the third bore.

11. The bore selector of claim 10, further comprising means connected to the second end of the stem for moving the stem.

12. The bore selector of claim 11, wherein the second end of the stem comprises a grab formation and the moving means comprises an ROV which is adapted to engage the grab formation.

13. The bore selector of claim 11, wherein the moving means comprises a hydraulic actuator.

14. The bore selector of claim 11, wherein the second bore comprises a retainer valve for controlling flow through the second bore and a retainer valve actuator for selectively opening or closing the retainer valve, and the moving means comprises the retainer valve actuator and means for coupling the movement of the retainer valve actuator to the second end of the stem.

15. The bore selector of claim 14, wherein the coupling means comprises a mechanical linkage.

* * * * *